US005771722A

United States Patent [19]

DiVito et al.

[11] Patent Number: 5,771,722

[45] **Date of Patent: *Jun. 30, 1998**

[54] DUAL CONTROL MODE LOCK SYSTEM

[75] Inventors: Thomas J. DiVito; Edward F. Humphrey, both of Southington, Conn.

[73] Assignee: Kaba High Security Locks Corporation, Southington, Conn.

[ * ] Notice: The term of this patent shall not extend beyond the expiration date of Pat. No. 5,423,198.

[21] Appl. No.: 483,277

[22] Filed: Jun. 7, 1995

Related U.S. Application Data

[63] Continuation-in-part of Ser. No. 152,220, Nov. 12, 1993, Pat. No. 5,423,198.

[51] Int. Cl.[6] ..... E05B 49/00

[52] U.S. Cl. ..... 70/278; 70/283; 340/825.31

[58] Field of Search ..... 70/408, 278, 277, 70/279–282, 283; 340/825.31; 361/172

[56] References Cited

U.S. PATENT DOCUMENTS

| | | | |
|---|---|---|---|
| 4,603,564 | 8/1986 | Kleinhany et al. | 70/282 X |
| 4,658,105 | 4/1987 | Seckinger | 200/43.05 |
| 4,686,358 | 8/1987 | Seckinger et al. | 235/382 |
| 4,730,471 | 3/1988 | Seckinger et al. | 70/277 |
| 4,745,785 | 5/1988 | Uebersax | 70/279 |
| 4,761,976 | 8/1988 | Kleinhany | 70/277 |
| 4,771,620 | 9/1988 | Kleinhany | 70/277 |
| 4,789,859 | 12/1988 | Clarkson et al. | 70/278 X |
| 4,848,115 | 7/1989 | Clarkson et al. | 70/278 X |
| 4,854,146 | 8/1989 | O'Connell et al. | 70/277 |
| 4,858,453 | 8/1989 | Namazue | 70/278 |
| 4,868,409 | 9/1989 | Tanaka et al. | 70/271 X |
| 4,939,915 | 7/1990 | Vonlanthen | 70/279 X |
| 4,998,952 | 3/1991 | Hyatt, Jr. et al. | 70/395 |
| 5,140,317 | 8/1992 | Hyatt, Jr. et al. | 340/825.31 |
| 5,373,718 | 12/1994 | Schwerdt et al. | 70/278 |
| 5,469,727 | 11/1995 | Spahn et al. | 70/278 |

FOREIGN PATENT DOCUMENTS

| | | | |
|---|---|---|---|
| 0329931 | 8/1989 | European Pat. Off. | 70/278 |
| 2518618 | 6/1983 | France | 70/278 |
| 5141139 | 6/1993 | Japan | 70/278 |
| WO87/00234 | 1/1987 | WIPO | 70/278 |
| WO88/00635 | 1/1988 | WIPO | 70/278 |

*Primary Examiner*—Lloyd A. Gall
*Attorney, Agent, or Firm*—Alix, Yale & Ristas, LLP

[57] ABSTRACT

A security system requires the bringing together, at the locking mechanism to be operated from a locked to an unlocked state, of a properly bitted mechanical key and the generator of a digitally coded electrical command signal. The electrical command signal is transmitted through the lock to an actuator so that the lock, when enabled by insertion of the mechanical key, may be operated. The key may define a portion of the signal transmission path between the command signal generator and the actuator.

17 Claims, 7 Drawing Sheets

DUAL CONTROL MODE LOCK SYSTEM

CROSS-REFERENCE TO RELATED APPLICATION

This application is a continuation-in-part of application Ser. No. 152,220 filed Nov. 12, 1993 now U.S. Pat. No. 5,423,198.

BACKGROUND OF THE INVENTION

1. Field of the Invention

The present invention relates to improvements in access control and particularly to enhancing the security of locking systems by requiring that at least two, and preferably three, access codes be substantially simultaneously delivered to a locking mechanism in order to allow the operation thereof from a locked to an unlocked state and by providing for the recordation of data commensurate with each unlocking operation. More specifically, this invention is directed to a hybrid security system, and especially a system which employs a cylinder lock, which may be operated only when a properly bitted mechanical key is inserted in the keyway of the plug portion of the cylinder lock and an electrical signal is simultaneously generated to enable the mechanical lock by causing one or more pin tumbler stacks which are not operated by the mechanical key to be displaced to the unlocked position. Accordingly, the general objects of the present invention are to provide novel and improved methods and apparatus of such character.

2. Description of the Prior Art

Mechanical locks which afford an exceptionally high degree of security, i.e., locks which are exceedingly difficult to defeat, are well known in the art. An example of such a lock, which is of the cylinder type, may be seen from FIG. 1 of U.S. Pat. No. 4,823,575. In situations where a high degree of security is required, locks of the type shown in U.S. Pat. No. 4,823,575 are desirable because the security offered by the lock may be enhanced by periodic replacement of the cylinder or plug portion of the lock, i.e., the lock may be rekeyed. There are, however, many applications where the security afforded by a lock which is responsive to a single access control device, such as a key, is considered insufficient.

Electromagnetically activated security devices have also previously been proposed and, in some cases, actually constructed and installed. These electromagnetically activated devices have employed a solenoid and associated plunger to perform a latching function, i.e., either the solenoid plunger functioned as a bolt or the state of energization of the solenoid determined whether a bolt could be moved. Examples of prior art electromagnetically activated security devices may be seen from U.S. Pat. Nos. 4,603,564, 4,730,471, 4,761,976 and 5,140,317. The prior art electromagnetically activated security devices were generally characterized by volumetric inefficiency, the possibility of defeating the lock upon accidental or deliberate disabling of the solenoid actuator and by the use of a single access control device.

Electronic access control systems, i.e., systems which switch power to a solenoid of an electromechanically activated security device in response to recognition of an electronically transmitted access code, are also well known in the art. The more sophisticated of such electronic systems have the desirable attribute of a programmable access code. Some of the previously available electronic access control systems include mechanical keys having built-in electronics for providing a coded signal which is recognized, and responded to, by circuitry included within the cooperating lock. Such electronic access control systems have previously been sold by the assignee of the present invention under the trademarks "KABA NOVA" and "LEGIC".

Security systems have also been proposed wherein a single key, with built-in electronics, may be utilized to operate either a mechanical lock of the type disclosed in U.S. Pat. No. 4,823,575 or an electronic access control. Such systems could theoretically enhance security by requiring serial operation of mechanical and electronic locking devices.

The prior art has not provided a locking system wherein all of the protective features of both mechanical and electronic locks were incorporated into a single, volumetrically efficient locking device which, in order to be actuated from a locked to an unlocked condition, would have to substantially simultaneously recognize both a mechanical code, in the form of key cross-sectional profile and bitting, and an electronic code. Such a highly desirable locking system would also be characterized by an inability to defeat the lock by disabling the electronic control, and particularly the electromagnetic actuator associated therewith, or by "picking" the mechanical lock.

It is to be noted that locking systems have previously been proposed which require the simultaneous presentation of two control devices in order to permit access. In a basic form, such systems are embodied in conventional safe-deposit boxes which require two mechanical keys to be simultaneously operated to afford access. Such prior locking systems which require plural simultaneous control actions, however, have typically also required the use of dual locks or have resorted to blocking motion of the bolt, as opposed to immobilizing the plug portion of a rekeyable cylinder lock, as one of the two locking mechanisms. Bolt immobilization is inefficient, relatively easy to defeat and relatively expensive from both a manufacturing and installation viewpoint.

The above-referenced parent application discloses a locking system which, for operation, requires the substantially simultaneous use of two dissimilar devices which are brought together to, in effect, form a composite key which is employed solely for the purpose of gaining entry, the two devices thereafter being maintained under the control of different individuals. However, even the system of the parent application fails to afford the requisite degree of security for some situations. For example, should an unauthorized party obtain possession of the electronic control portion of the composite key of the composite key of the parent application, access to the secured enclosure would theoretically be possible through picking the mechanical lock. Thus, it would be desirable to impose a third level of security and, particularly, an enabling device for the electronic control.

It is also desirable, particularly when the lock system controls access to a cache of coins or the like, to have a record of each unlocking operation and, possibly, also the state of certain parameters of the apparatus associated with the lock at the time of each unlocking. While such data can be collected by telemetry techniques, it is expensive and inconvenient to do so.

SUMMARY OF THE INVENTION

The present invention overcomes the above briefly discussed and other deficiencies and disadvantages of the prior art by providing a novel and improved security system wherein a single locking mechanism, a rekeyable cylinder-type lock for example, may be operated from a locked to an unlocked state only upon the simultaneous presentation, at the lock, of two codes which are created in different mediums. Additionally, in accordance with the invention, the means for generating one of the two codes must be periodically reactivated by delivering a further code thereto. The first of the two aforementioned codes is in a mechanical format, and particularly comprises the profile of and bitting on the blade of a key. A properly bitted key will "enable" the lock such that, upon receipt of the second code, the plug may be rotated relative to the cylinder to actuate a bolt. In a security system in accordance with a preferred embodiment of the invention at least one pin tumbler stack of the cylinder lock is displacable in response to detection of a "match" between digitally encoded identification information stored both in the enclosure in which the lock is installed and in an electronic "key" which, when in an activated state, cooperates with the mechanical key. Also in the preferred embodiment, the position of the pin tumbler stack(s) which are subject to electrical control is varied electromagnetically. The electromagnetically displacable pin tumber stack(s), in the same manner as the mechanically operated pin tumblers of the cylinder lock, will prevent rotation of the plug relative to the shell of the cylinder until the "match" has been made while the first coded signal is present. The actuator(s) for the electromagneticaly displacable pin tumbler stack(s) is a solenoid(s) which is energized by control electronics associated with the lock, the control electronics storing and providing the encoded identification information.

A particularly novel feature of the invention is the requirement for period reactivation of the electronic key by the delivery thereto of a "message" previously stored in a portable data storage device which is brought to the key. The electronic key will include a "clock" which will time out after each activation, i.e., a failure to reactivate the key within a preselected time period will disable the ability of the key to "match" identification information provided by the lock. A further feature of the invention is the ability to use the key as an electronic data collection device. Thus, the electronic portion of the composite key of the invention includes a memory for recording information commensurate with each activation, each "match" or attempt to "match" and, in some applications, selected data stored in the electronics associated with the mechanical portion of the lock system.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENTS

Figure 1:
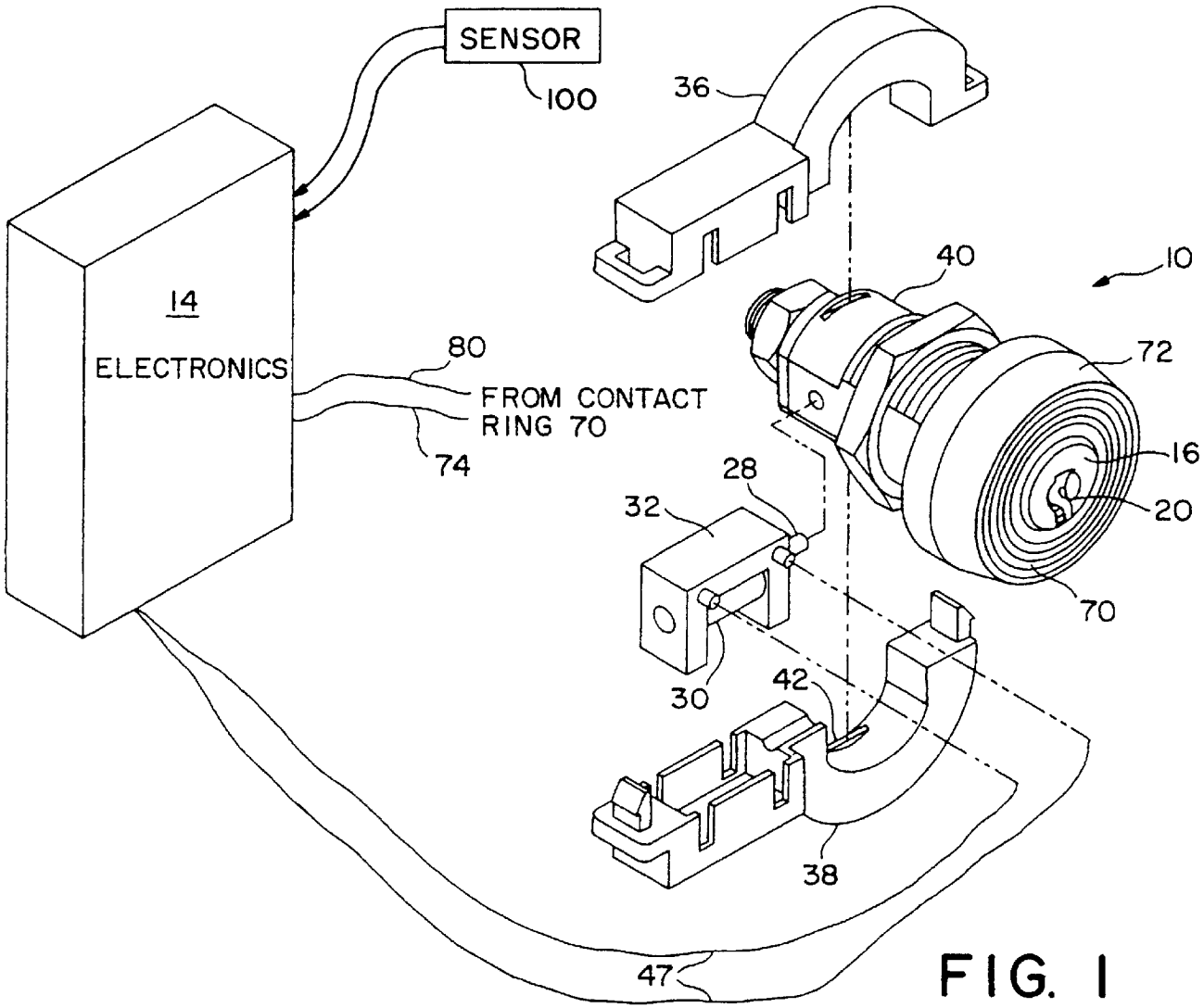
FIG. 1 is an exploded perspective view of a first embodiment of the lock of a security system in accordance with the present invention.
Figure 2:
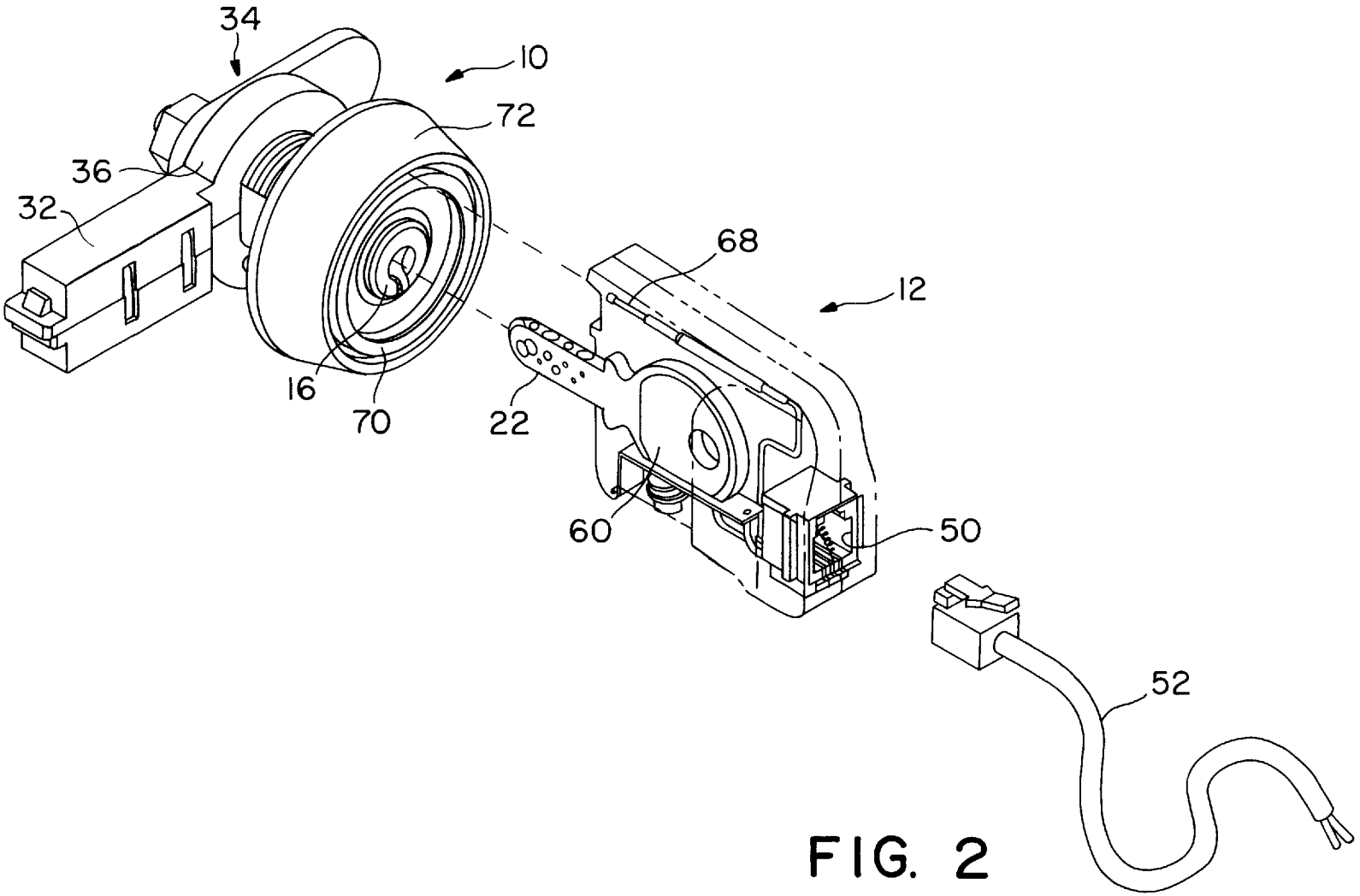
FIG. 2 is a perspective view, partly in phantom, of a portion of a composite key which may be utilized with the lock of FIG. 1, FIG. 2 also showing the lock of FIG. 1 in the assembled condition.
Figure 3:
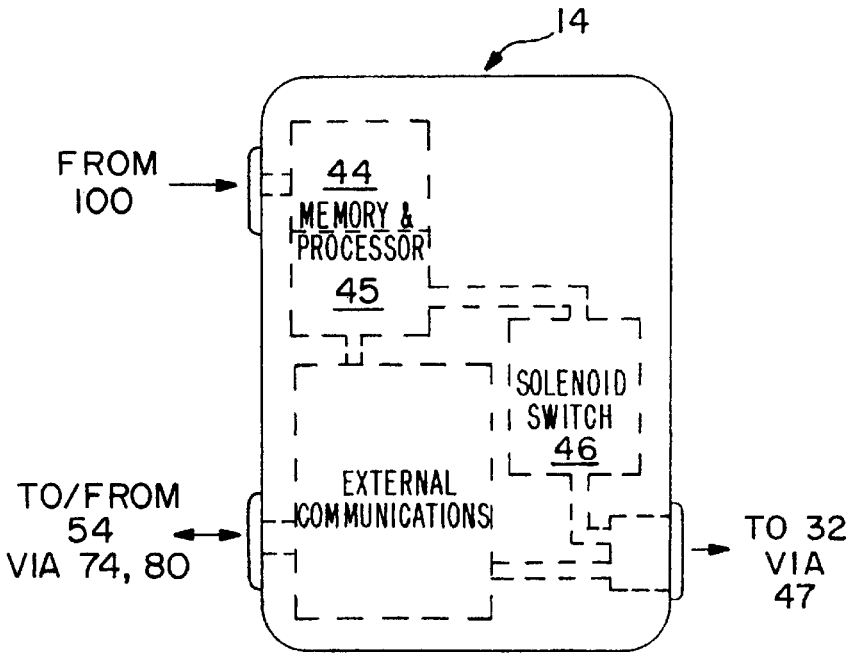
FIG. 3 is a schematic illustration of the control module of the lock of FIG. 1.
Figure 6:
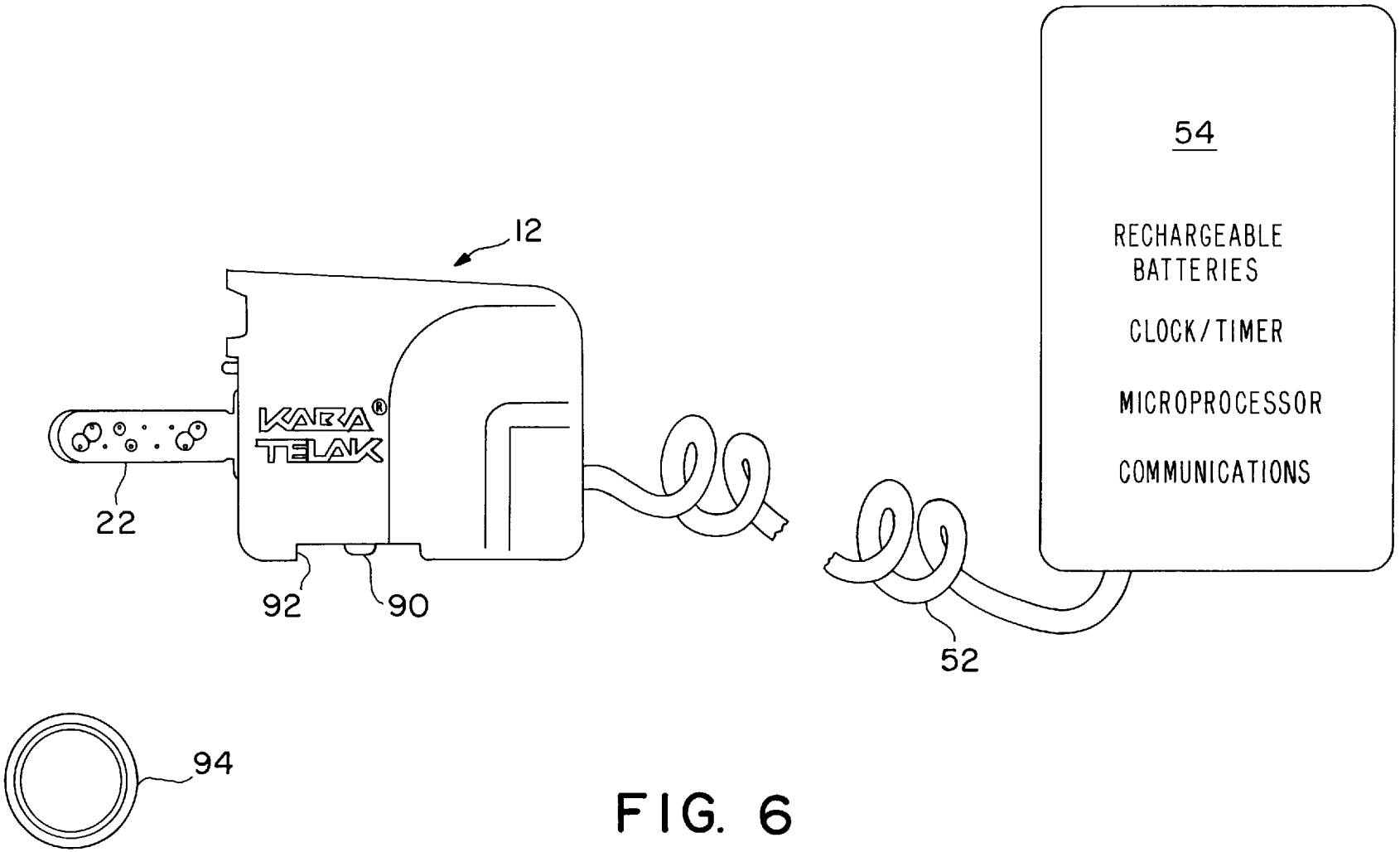
FIG. 6 is a schematic view of the components of a composite key in accordance with the invention.

With reference now to the drawings, a security system in accordance with a first embodiment of the present invention comprises a lock, indicated generally at 10 in FIG. 1, a cooperating "key", shown partly and generally at 12 in FIG. 2, a control module, indicated generally at 14 in FIG. 1, an electronic command module, indicated generally at 54 in FIG. 6, and a device for periodically reactivating command module 54, indicated at 94 in FIG. 6. As will be described below, the control module 14 will be directly coupled to the lock 10, i.e., direct electrical connections for control signal and power transmission will be established in the manner depicted in FIG. 1. Control module 14 will be installed in the same equipment, a coin collection apparatus of some type for example, which houses the lock. A digitally coded identification signal will, in the disclosed embodiment, be generated by logic circuitry within control module 14 upon receipt of an interrogation command from command module 54 via key 12. The interrogation command may simply be the application of power to module 14. The identification signal will, when generated, be transmitted to the command module 54 via a conductive path established through the lock and key, i.e., the identification signal will be sent over the same path as the interrogation signal.

The lock 10 is a modified version of a cylinder type lock which may, for example, be of the type disclosed in U.S. Pat. No. 4,823,575. Referring jointly to FIGS. 1 and 5, the cylinder lock includes a plug 16 which is rotatable in a shell 18, the plug defining a keyway 20. It will be understood that the lock 10 may be "rekeyed" by replacement of the cylinder including the plug. The means by which such rekeying is accomplished is known in the art and has been omitted from the drawings in the interest of facilitating understanding of the invention. It will further be understood that a tailpiece, not shown, will customarily be mechanically coupled to the inwardly disposed end of the plug 16 for operating a bolt between the locked and retracted positions in response to rotation of plug 16 relative to shell 18.

Rotation of plug 16 relative to shell 18 of lock 10 is accomplished by applying torque to a properly profiled and bitted blade 22 of a mechanical key which has been inserted into the keyway 20 in plug 16. In the disclosed embodiment the bitting on key blade 22 is in the form of a pattern of dimples of different size, depth and angular orientation in plural sides of the blade as shown in U.S. Pat. No. 4,823,575. These dimples cooperate with pin tumbler stacks housed in the shell and plug of lock 10 such that, when a properly bitted key blade is inserted into the keyway, the shear lines between the cooperating bottom and driver pin tumbler stacks will be in registration with a cylindrical interface between the plug and shell thus permitting plug rotation. The bitting on the key blade, accordingly, comprises the first of a pair of coded input signals which are required to operate lock 10. However, in accordance with the present invention, the insertion of a properly bitted key blade into keyway 20 will not permit rotation of the plug 16 until at least one further pin tumbler stack, which may not be accessed via the keyway 20, has been displaced.

Figure 4:
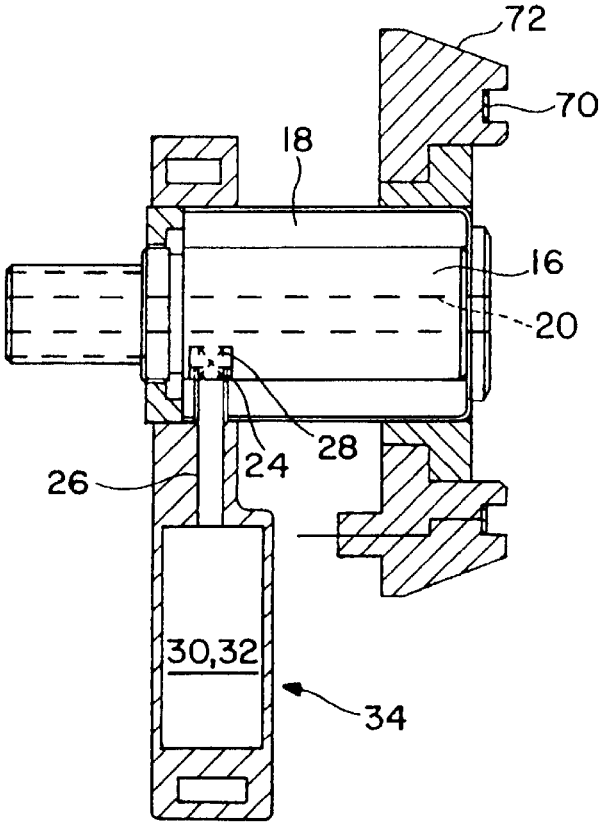
FIG. 4 is a top plan view, partly in section, which depicts the cooperation between the solenoid actuator and cylinder lock portions of the lock of FIG. 1.
Figure 5A:
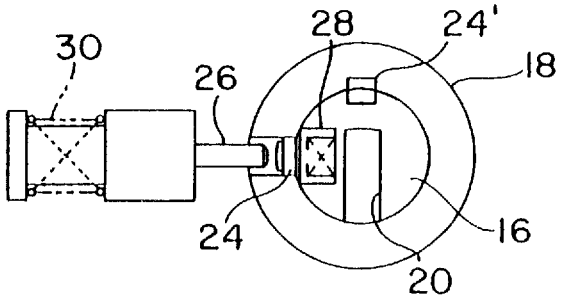
FIGS. 5A, 5B and 5C schematically illustrate the operation of the portion of the lock depicted in FIG. 4.
Figure 5B:
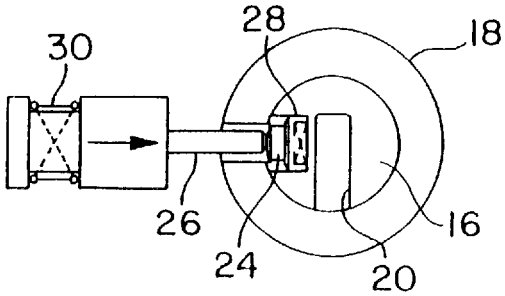
Figure 5C:
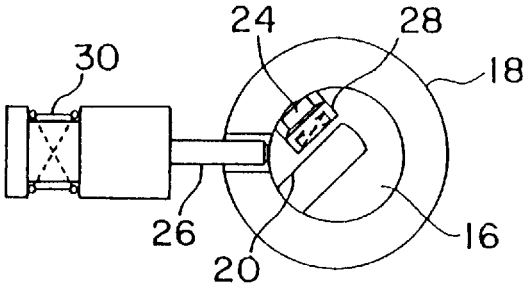

The above-mentioned further pin tumbler stack provided within lock 10 includes a spring biased bottom pin 24, which may be seen from FIG. 5, and a cooperating driver pin 26. Bottom pin 24 is biased, by means of a spring 28, so as to normally extend across a shear line between plug 16 and shell 18 thus preventing plug rotation. As may be seen from FIGS. 4 and 5, the pin chamber in the lock which accommodates the tumbler stack 24, 26 does not communicate with keyway 20. An extension of driver pin 26 is at least in part comprised of magnetic material and forms the plunger of a push-type solenoid 30. Bottom pin 24 will be pushed, against the bias of spring 28, into a receiving bore provided therefor in plug 16, i.e., to the position shown in FIGS. 5B and 5C, by energization of solenoid 30. FIG. 5A schematically shows pin 26 in the solenoid deenergized position corresponding to the locked state. FIGS. 4 and 5B show pin 24 in the depressed position resulting from the force provided by energizing solenoid 30, the motion of solenoid plunger being delivered to pin 24 by driver pin 26. As shown in FIG. 5C, the outer end of bottom pin 24 will ride on an inside diameter of shell 18 of lock 10 during rotation of plug 16 in response to the application of torque to key blade 22 after energization of solenoid 30.

The solenoid 30 is mounted in a holder 32 which, in turn, is received in a two piece housing indicated generally at 34 in FIG. 2. Housing 34 is defined by upper and lower clamp members 36 and 38 which may be fitted over holder 32 and snapped together. An outer shell 40 of the cylinder lock is provided with slots which receive locating projections 42 on clamp members 36 and 38, the cooperation between the slots and projections insuring proper positioning of the solenoid relative to the cylinder lock.

In accordance with the preferred mode of operation of the invention, in the manner to be described below, the solenoid 30 may be energized after full insertion of the key blade 22 into keyway 20. The energization of solenoid 30 needs to be only momentarily, i.e., once the plug 16 has been rotated a few degrees from the locked position the bottom pin 24 can not extend across the shear line until the plug is returned to the angular orientation commensurate with the locked condition.

To summarize the above, lock 10 may be operated from the locked to the unlocked condition only in response to simultaneous application of a pair of signals. The first of these signals is mechanically formatted, i.e., the first signal comprises the cross-sectional shape of and bitting provided on the key blade 22, while the second signal is electrically produced in the manner to be described below. The second signal will cause energization of solenoid 30 to displace the pin tumbler stack which includes bottom pin 24 whereby torque which is being applied to the blade 22 of a properly bitted key at the time of solenoid energization will cause rotation of the plug 16 relative to shell 18.

The control module 14 includes electronics in the form of a microprocessor 45, with associated memory 44, and a microprocessor controlled solid state switch 46 for energizing solenoid 30 via conductors 47. The memory 44 associated with microprocessor 45 will store a multi-digit identification code which is unique to the lock. All power required for operation of microprocessor 45 and solenoid 30, will be provided from an external source associated with command module 54.

When interrogated by an external signal, i.e., when activated by the delivery of power thereto through key 12, control module 14 will generate a pulse train commensurate with its digitally encoded identification number. This coded signal will be transmitted, via key 12, to the command module 54 where it will be compared with a stored identification code. If there is a "match", an energization command signal will be generated by command module 54 and this command signal will be transmitted back to microprocessor 44 via the key. Microprocessor 44 will, in response to receipt of a proper command, cause the solid state switch 46 to be "closed". The closing of switch 46 will establish a current flow path which includes the coil of solenoid 30 thereby energizing the solenoid and displacing the pin tumbler stack 24, 26 against the bias of spring 28 as described above.

Figure 7:
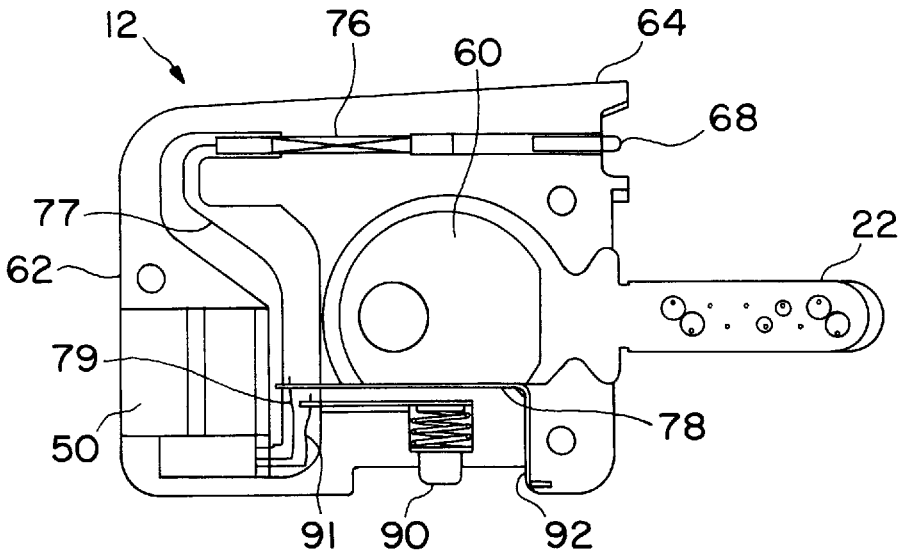
FIG. 7 is a cross-sectional side elevation view of the portion of the key which is shown in FIG. 2.

In the disclosed embodiment, and referring jointly to FIGS. 2, 6 and 7, key 12 is provided with a jack 50 having a plurality of contacts. Jack 50 will be coupled, via a plug on the end of a cable 52, to command module 54 (FIG. 6). In the disclosed embodiment, command module 54 includes a microprocessor, a clock and associated communications circuitry. The command module 54 also includes a rechargable battery pack 56. In the typical use enironment, the command module 54 will be carried by a first security officer while the mechanical key 12 will be carried by a second security officer.

Figure 8:
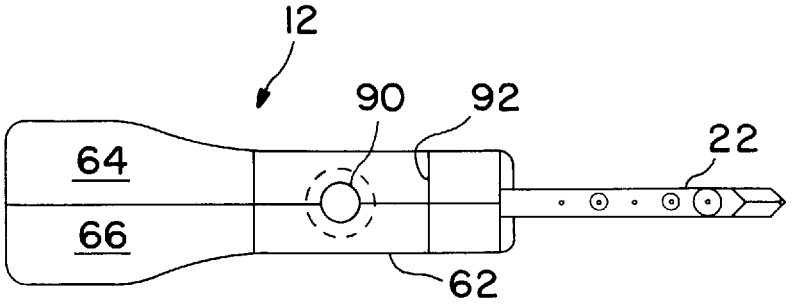
FIG. 8 is a bottom view of the apparatus depicted in FIG. 7.
Figure 9:
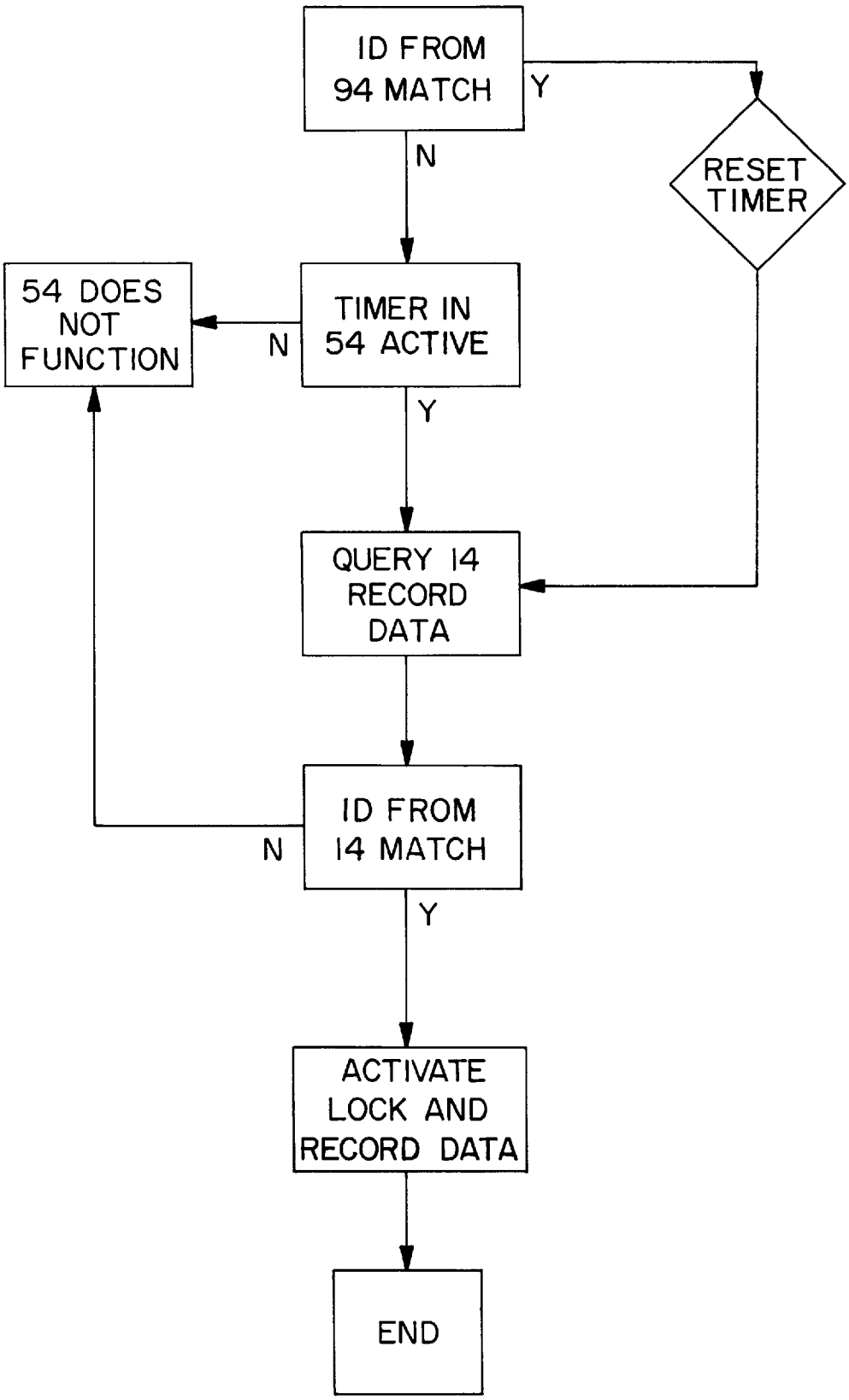
FIG. 9 is a diagram which represents the mode of operation of the command module of the composite key of the invention.

Referring to FIGS. 2, 7 and 8, key 12 includes a matable combination of a mechanical key, comprising blade 22 and a bow portion 60, and an electrically insulated key holder 62. The key holder 62 is defined by a pair of molded plastic members 64 and 66 which are provided with recesses in the facing sides thereof. These recesses are sized and shaped to define a receiver for the bow 60 of the mechanical portion of the composite key. In the disclosed embodiment the key holder 62 is provided with a first spring loaded contact pin 68 which cooperates with a contact ring 70 provided at the front of lock 10. Contact ring 70, as best seen from FIG. 4, is received in an annular recess of a collar 72. Collar 72 is comprised of a non-conductive material and, accordingly, ring 70 is electrically insulated from the lock. The contact ring 70 is connected, via an insulated conductor 74 which extends through a bore provided therefore in collar 72, to control module 14.

Returning to a discussion of key 12, pin 68 is electrically connected to a first conductor of cable 52 via a conductive spring 76, wire 77 and jack 50 as shown in FIG. 7. When key blade 22 is fully inserted in the keyway of lock 10, pin 68 will be urged against contact ring 70 by biasing spring 76 thus insuring a good electrical contact between the pin and ring. Also, the bow 60 of the mechanical key is sandwiched in key holder 62 in such a manner as to insure establishment of electrical contact between the electrically conductive key and a terminal 78 provided on holder defining member 64. Terminal 78 is electrically connected to jack 50 via wire 79 and, via jack 50, to a second conductor of cable 52. Thus, full insertion of key blade 22 in the plug 16 of lock 10 will establish a complete electrical circuit for power and signal transmission between control module 14 and command module 54 with the lock cylinder and mechanical key defining, in the disclosed embodiment, a portion of a first conductor 80 of this circuit.

In the operation of the disclosed embodiment, when the plug on the end of cable 52 is inserted in jack 50 and the key blade 22 has been inserted in the keyway 20 in plug 16, and provided that the command module has been reactivated within a predetermined preceding time period in the manner to be described below, the control module 14 will be energized, i.e., interrupted, and the identification code of lock system 10 will be read from memory 44 by microprocessor 45 and transmitted from control module 14 to command module 54. The transmitted data will be compared with data stored in module 54 and, in the manner described above, a "match" will result in generation of a command which will cause activation of switch 46.

A key in accordance with the invention will also be provided with a second spring loaded contact pin 90 which is electrically connected via conductor 91 to a third contact in plug 50. The key will additionally have a fourth contact 92 which is electrically connected to terminal 78. Contacts 90 and 92 are spaced and shaped so as to cooperate with a touch memory 94 such as, for example, a semiconductor memory chip packaged in a coin shaped can. Such touch memories are available from Dallas Semi-Conductor and may, for example, be mounted on an identification card. A touch memory has the ability of reading or writing with a momentary contact and communicates to a host device via a single signal. The momentary establishment of contact between the contacts of touch memory 94 and contacts 90 and 92 of key 12 results in the application of the requisite source voltage for operation of the touch memory. The touch memory, in turn, will respond with the programmed information. This programmed information may include the identification of the individual carrying the touch memory. The information read out of touch memory 94 will be transmitted to the microprocessor in command module 54 where a comparison will occur. If the information stored in the touch memory is commensurate with authorization to operate lock 10 and the read-out of memory 94 is "current", control module 14 may be interrogated in the manner described above. The read-out of touch memory 94 will start a timer in command module 54 and the command module will begin to "time-out". After the predetermined time out period, command module 54 will be disabled until such time as it is reactivated by again bringing touch memory 94 into contact with the key contacts 90 and 92.

To summarize operation of a lock system in accordance with the present invention, three separate code comparisons must be satisfied within a predetermined time period in order to permit operation of lock 10. Firstly, command module 54 must be activated in response to the code stored in touch memory 94 satisfying criteria stored in the memory of the command module. Secondly, the code stored in control module 14 must also satisfy criteria stored in command module 54. Thirdly, the code on the blade 22 of key 12 must satisfy the criteria established by the pin tumbler stacks of lock 10. Lock 10 may not be operated without all three components, i.e., key, command module and touch memory being present and having stored therein proper code information.

The only subsystem of the lock control system which has a permanent power source is the command module 54. Command module 54 thus has the capability of collecting and storing data. This data may be periodically read out of the command module via a communications port and subsequently analyzed. The data collected in the memory of command module 54 will, in the typical use environment, include the time of each establishment of contact between the touch memory and key contacts and the identification of the particular touch memory. The command module may also store information commensurate with the code transmitted by control module 14 immediately prior to each energization of solenoid 30 and the time of such code transmission. Thus, a record will be created detailing each attempt to gain access to the interior of the equipment protected by lock 10.

Since the equipment in which the lock 10 is installed will typically have a power source, it is also possible to have the memory 44 of control module 14 permanently enabled to receive data. A sensor 100 may be provided on the machine and provide data commensurate with machine operation to memory 44. This information may be read from memory 44 into the memory of command module 54 in response to each solenoid energization command signal. Thus the command module 54 may perform a secondary function of collecting data for inventory control, history of openings, or other purposes.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A lock system comprising:

lock means, said lock means including a plug which is rotatable within a cylinder, the plug and cylinder each having at least a first array of alignable first pin tumbler receiving chambers, said plug defining a keyway, the chambers of said first array in said plug and cylinder communicating with said keyway, primary pin tumbler stacks being disposed in at least some of said chambers for displacement by a blade of a key inserted in said keyway, said lock means further including at least a first movable blocking member for preventing rotation of said plug relative to said cylinder when said primary pin tumbler stacks are displaced by a properly bitted key, said blocking member being isolated from said keyway when said first pin tumbler chambers of said arrays are in alignment;

actuator means for said blocking member, said actuator means being normally deenergized and converting an applied electrical signal to motion when energized, said motion being delivered to said blocking member whereby said plug may be rotated by a properly bitted key;

control signal generator means for producing an encoded electrical lock identification signal in response to an interrogation signal, said control signal generator means producing an energizing signal for said actuator means in response to a command signal;

key means, said key means including a blade which is bitted to define a coded mechanical signal whereby insertion of said blade into said keyway will cause displacement of said primary pin tumbler stacks to enable rotation of said plug relative to said cylinder upon production of said energizing signal;

active command signal generator means for producing said interrogation signal and said command signal, said command signal generator means including data processor means and data storage means for storing lock identification information, said command signal generator means producing said command signal in response to recognition of said encoded lock identification signal by said data processor means, said command signal generator means further including timer means for enabling the production of at least one of said interrogation signal and said command signal, said timer means having an enablement time of preselected duration and being responsive to receipt and recognition of an encoded enablement signal by said command signal generator means;

static information storage means for providing said encoded enablement signal to said command signal generator means upon stimulation by a voltage source; and means for establishing signal transmission paths between said command signal generator means and both of said control signal generator means and said static information storage means.

2. The system of claim 1 wherein said signal transmission paths include said key means.

3. The system of claim 2 wherein said key means includes:

a mechanical key having a blade comprised of electrically conductive material;

a key holder of non-conductive material; and first and second pairs of contacts supported in said holder, a first contact of said first pair being positioned and configured to engage a conductive terminal displaced from said keyway when said key blade is fully inserted into said keyway, said terminal comprising a part of said control signal generator means, said contacts of said second pair being positioned and configured for establishment of electrical contact with said static information storage means.

4. The system of claim 3 wherein the second contact of said first pair of contacts comprises said key blade.

5. The system of claim 4 wherein said key holder includes socket means, said socket means defining portions of said signal transmission paths establishing means and wherein said command signal generator means includes an electrical cable and plug means which mates with said socket means, said command signal generator means and said key means being separable and connected by said cable only for the purposes of operating said lock system.

6. The system of claim 5 wherein said first contact comprises a spring-loaded conductive pin.

7. The system of claim 1 wherein said actuator means includes a solenoid.

8. The system of claim 1 wherein said lock means includes:

a first conductive terminal accessible at a front face of said lock means at a position displaced from said keyway;

a first conductor extending between said first terminal and said control signal generator means, said first conductor being electrically isolated from said plug and cylinder; and means for electrically connecting said plug to said control signal generator means.

9. The system of claim 8 wherein said signal transmission paths include said key means.

10. The system of claim 9 wherein said key means includes:

a mechanical key having a blade comprised of electrically conductive material;

a key holder of non-conductive material; and first and second pairs of contacts supported in said holder, a first contact of said first pair being positioned and configured to engage said first conductive terminal when said key blade is fully inserted into said keyway, said contacts of said second pair being positioned and configured for establishment of electrical contact with said static information storage means.

11. The system of claim 10 wherein the second contact of said first pair of contacts comprises said key blade.

12. The system of claim 11 wherein said key holder includes socket means, said socket means defining portions of said signal transmission paths establishing means and wherein said command signal generator means includes an electrical cable and plug means which mates with said socket means, said command signal generator means and said key means being separable and connected by said cable only for the purposes of operating said lock system.

13. The system of claim 12 wherein said first contact comprises a spring-loaded conductive pin.

14. The system of claim 13 wherein said actuator means includes a solenoid.

15. A lock system comprising:

lock means, said lock means including a plug which is rotatable within a cylinder, the plug and cylinder each having an array of alignable first pin tumbler receiving chambers, said plug defining a keyway, the chambers of said first array in said plug and cylinder communicating with said keyway, primary pin tumbler stacks being disposed in at least some of said chambers for displacement by a blade of a key inserted in said keyway, at least a first secondary pin tumbler stack receiving chamber in each of said plug and cylinder, said secondary chambers being in alignment when the chambers of said first array are in alignment, said secondary chambers being isolated from said keyway when said primary chambers are in alignment, a secondary pin tumbler stack disposed in said secondary receiving chambers, said secondary stack including at least a bottom pin tumbler and a driver pin tumbler, one of said pin tumblers of said secondary stack bridging the space between said plug and cylinder when the lock system is in the locked state;

actuator means for said secondary pin tumbler stack, said actuator means including a normally deenergized solenoid and converting an applied electrical signal to motion when energized, said motion being delivered to said driver pin tumbler of said secondary stack to displace said stack to a position where a shear line between a pair of pin tumblers thereof is aligned with the space between said plug and cylinder;

means for generating an energizing signal for said actuator means, said energizing signal generating means being responsive to a coded electrical command signal;

a mechanical key having a blade comprised of electrically conductive material, said blade being bitted to define a coded mechanical signal whereby insertion of said blade into said keyway will cause displacement of said primary pin tumbler stacks to enable rotation of said plug relative to said cylinder upon generation of said energizing signal;

a holder comprised of non-conductive material for receiving said key; and contact means carried by said holder, said contact means being positioned and configured to engage a conductive terminal displaced from said keyway when said key blade is fully inserted into said keyway;

command signal producing means for producing said coded electrical command signal for said energizing signal generating means; and means for establishing a pair of electrically conductive paths between said command signal producing means and said energizing signal generating means, said conductive paths extending through said lock means.

16. The system of claim 15 wherein a first conductor of said pair of conductive paths includes said key blade.

17. The system of claim 16 wherein said key holder includes socket means, said socket means defining portions of said conductive paths, and wherein said command signal producing means includes an electrical cable and plug means which mates with said socket means, said command signal producing means and said key means being separable and connected by said cable only for the purposes of operating said lock system.

* * * * *